US005295622A

United States Patent [19]

Lorber

[11] Patent Number: 5,295,622

[45] Date of Patent: Mar. 22, 1994

[54] FOLDER OR THE LIKE

[76] Inventor: Kurt Lorber, Schurwaldstrasse 114, D-7307 Aichwald 2, Fed. Rep. of Germany

[21] Appl. No.: 834,476

[22] Filed: Feb. 12, 1992

[30] Foreign Application Priority Data

Feb. 15, 1991 [DE] Fed. Rep. of Germany ..... 4104673
Oct. 29, 1991 [DE] Fed. Rep. of Germany ..... 4135567

[51] Int. Cl.[5] ..... B65D 27/00

[52] U.S. Cl. ..... 229/1.5 R; 211/46; 312/184

[58] Field of Search ..... 229/DIG. 2, 1.5 R; 312/184; 40/359; 211/45, 46

[56] References Cited

U.S. PATENT DOCUMENTS

| | | | |
|---|---|---|---|
| 201,004 | 3/1878 | Gormon | 229/1.5 R |
| 814,950 | 3/1906 | Evans | 229/1.5 R |
| 815,214 | 3/1906 | Rand | 229/1.5 R |
| 947,218 | 1/1910 | MacGregor | 229/1.5 R |
| 1,466,308 | 8/1923 | Livingston | 229/1.5 R |
| 2,165,157 | 7/1939 | Smith | 312/184 |
| 3,255,758 | 6/1966 | Gauche | 312/184 |
| 3,936,201 | 2/1976 | Kenney et al. | 312/184 |
| 4,395,058 | 7/1983 | Terrell | 312/184 |
| 5,048,697 | 9/1991 | Payne | 229/1.5 R |
| 5,154,527 | 10/1992 | Blessing | 312/184 |

FOREIGN PATENT DOCUMENTS

| | | | |
|---|---|---|---|
| 1176609 | 8/1964 | Fed. Rep. of Germany | 312/184 |
| 1236472 | 3/1967 | Fed. Rep. of Germany . | |
| 8613224 | 3/1987 | Fed. Rep. of Germany . | |
| 3639785 | 6/1988 | Fed. Rep. of Germany . | |
| 3813102 | 2/1989 | Fed. Rep. of Germany . | |
| 8712897 | 9/1989 | Fed. Rep. of Germany . | |
| 2049704 | 3/1971 | France . | |
| 880244 | 10/1961 | United Kingdom | 312/184 |
| 2019320 | 10/1979 | United Kingdom . | |
| 8404083 | 10/1984 | World Int. Prop. O. | 229/1.5 R |

*Primary Examiner*—Stephen P. Garbe
*Attorney, Agent, or Firm*—Quarles & Brady

[57] ABSTRACT

A folder for receiving documents or the like is formed from a corrugated board or paper blank, which is folded for forming a front sheet and a back sheet. For the retaining of the front and back sheets insert elements are used, which are inserted with pins in the open front faces of the blank. The folder can be produced with much less effort and expenditure than known folders and can be constructed as a hanging folder or as a rubber strip folder.

12 Claims, 2 Drawing Sheets

FOLDER OR THE LIKE

The invention relates to a folder for receiving documents or the like.

BACKGROUND OF THE INVENTION

It is known to use hanging folders for receiving files or unperforated written matter. They contain a front and a back sheet, which are interconnected either in the vicinity of the upper edge or in the vicinity of the lower edge. They are hung between two horizontally spaced rails. The known hanging folders contain through metal rails on whose ends hooks are formed. It is complicated to fix the blanks to the said rails. In the case of hanging folders both ends of the blank must in each case be wound around a rail and then glued or rivetted. In part the pockets for the insertion of the rails are formed beforehand and the rails are laterally inserted.

It is also known to fold the front and back cover in such a way that an insertion pocket for the hanging member is created, which is also inserted in a guidance channel of a viewing strip (German Patent 36 39 785).

In addition, rubber strip folders are known, in which the ends of a rubber band are fixed to one folder cover and with the folder closed is passed round the other cover, this normally taking place in the vicinity of the corners.

SUMMARY OF THE INVENTION

An object of the invention is to provide a folder which is constructed in simple manner and can be produced inexpensively.

As the web material for producing the folders, the invention e.g. proposes corrugated paper or board, i.e. a material which can be manufactured from reusable matter. Corrugated board exists with the most varied dimensions, also of the type which is relatively thin making it usable for folders. Such a folder has the advantage that it is inherently relatively stiff, so that it provides a good protection for the material to be placed therein. It is also possible to use a plastic web material, which has two outsides interconnected by webs. This material is also reusable.

For the production of the folder according to the invention, it is merely necessary to punch from the selected material, e.g. the corrugated board, a blank for which only one operation is necessary. The insert parts are then inserted at the corresponding points, i.e. in the upper area. The insert parts can be hook elements, so that the folder is then constructed as a hanging folder and can be hung on the hook elements.

However, the insert parts can also be constructed in such a way that they permit a fixing to one another of the front and back covers, e.g. with the aid of a rubber strip. In this case the insert part can have a hole through which the rubber band is inserted and fixed. It is also conceivable to construct the insert part in such a way that it fixes the other cover with projections, clasps or foldable parts. What is stated hereinafter in connection with the hook elements applies in the same way for the other insert parts.

The hook elements are in each case provided as a one-piece member for each side. Insertion can take place very simply and after insertion the hanging folder is finished. No additional operations are required. The hooks to be inserted can be introduced into the gaps between the webs at the intended points. However, they can also be inserted at random points on the side of the blank, so that the final user can also modify and convert the hanging folder.

The hanging folders can be constructed both as hanging pockets, i.e. with a connection of the two sheets of the blank on the underside, and as hanging booklets or files, the front and back sheets being interconnected in the vicinity of the top side. It is even possible to use the same blank for both cases. This can even take place subsequently by changing the hook elements.

The invention also proposes that the insert parts be integrally injection moulded from plastic.

It is possible on the insert parts and in particular the hook elements to shape a single pin, which is introduced into the insertion material and this is completely sufficient if the length is adequate. However, it is particularly advantageous to use two or more such pins, the load then being distributed over several webs or gaps between the webs.

According to the invention, as a result of the loading effect, the bottom pin of the insert part can be the longest.

According to the invention, if several pins are provided, all of them have different lengths, which can facilitate insertion.

According to the invention the individual pins have a spacing, which is at least sufficiently large to allow two adjacent pins not to be inserted in adjacent gaps between two webs. In particular the spacing between the individual pins can vary if there are more than two such pins.

According to the invention the thickness of the pins is smaller than the thickness of the insert part outside the insertion material. Thus, on inserting the insert part the latter is positioned on a larger surface on the hanging folder, which has a positive influence on the durability and appearance of the folder even after prolonged use.

The invention also proposes a hook element for hanging said hanging folders, an insert part for the folders not to be hung, as well as the use of said elements for fixing to hanging folders or other folders.

BRIEF DESCRIPTION OF THE DRAWINGS

Further features, details and advantages of the invention can be gathered from the following description of a preferred embodiment and the attached drawings, wherein show.

DETAILED DESCRIPTION OF THE PREFERRED EMBODIMENTS

Figure 1:
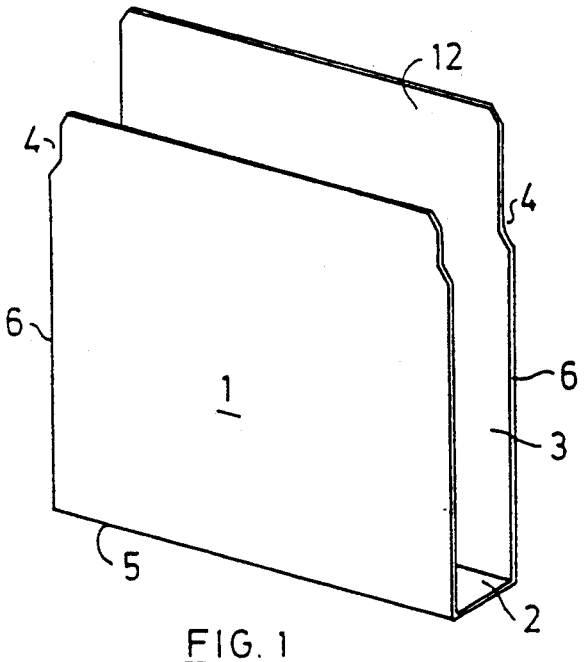
FIG. 1 a view of a hanging folder without hooks.

FIG. 1 is a perspective view of a blank for forming a hanging folder, which has a front sheet 1 and a back sheet 3 connected thereto via a bottom 2. The blank is folded in such a way that the front sheet 1 and back sheet 3 are substantially parallel to one another. In the vicinity of the upper ends of the front and back sheets they laterally in each case have a recess 4, in which the width of the hanging folder is consequently somewhat less. Subsequently the hook elements are inserted in these recesses. The blank shown perspectively in FIG. 1 is punched from a piece of corrugated board or paper, the latter being oriented in such a way that the webs are parallel to the bends 5 between the front sheet 1 and the bottom 2, or between the bottom 2 and the back sheet 3, i.e. in other words parallel to the direction between the longitudinal rails between which the hanging folders are to be inserted. On both lateral terminal edges 6 the hanging folder material is open, as is e.g. shown in FIG. 3.

A fold of the blank, as shown in FIG. 1, is normally referred to as a hanging folder, but the invention wishes for this term to be understood in a broader sense. If the terminal edges 6 of the front sheet 1 and the back sheet 3 are interconnected by paper strips or the like, such a blank is frequently also referred to as a hanging pocket.

On interchanging the top and bottom of the blank, so that the front sheet 1 and the back sheet 3 are interconnected in the vicinity of the top, then such means are referred to as hanging files. It is obviously possible in the case of the blank shown in FIG. 1 to turn it round and to fit the hook elements as yet to be described in the vicinity of the top, i.e. hitherto the bottom 2.

Figure 2:
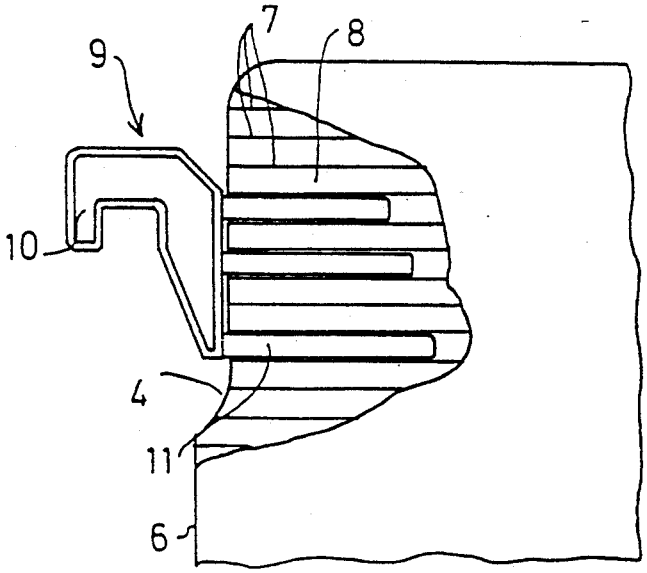
FIG. 2 a larger scale, part sectional side view of a corner of the hanging folder.

The partly broken away view of FIG. 2 shows how individual channel-like gaps 8 are formed between the corrugated board webs 7, which extend between side sheets 13 of the blank. On each front face of the blank in the vicinity of the upper edge thereof a hook element 9 is inserted close to the recess 4. The hook element 9 contains a downwardly open, substantially U-shaped hook 10 positioned outside the blank and which can be placed on a rail. On the side facing the terminal edge 6 of the blank the hook element contains three parallel pins 11 all of which have different lengths. The spacing between the pins 11 is such that each pin 11 can be inserted in a gap 8 between two adjacent webs 7. As the corrugated board material can be deformed and the pins 11 of the preferably plastic injection moulded hook element 9 can also yield somewhat, there is no need for a precise matching of the spacing of the pins 11 and the corrugated board.

As can be gathered from FIG. 2 the distance between the two upper pins is chosen in such a way that they engage in gaps 8 between which a further gap 8 is provided between two webs 7. Therefore the underside of the upper pin is not in engagement with the same web 7 as the top of the central pin. The distance between the central and the lower pins 11 is larger, so that between these there are three webs 7 or two gaps 8.

Figure 3:
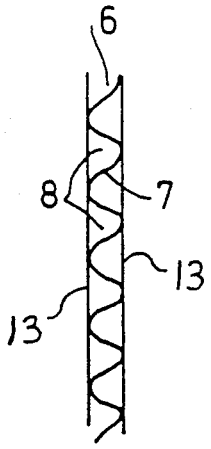
FIG. 3 diagrammatically a front view of a sheet of a corrugated board hanging folder.

FIG. 3 shows a view of the front face 6 of a blank showing with respect to the corrugated board a plurality of gaps 8 separated by webs 7. Deformation of the individual gaps 8 is possible as a result of the web material, so that the pins 11 of the hook element 9 do not have to be adapted to a special shape.

Figure 4:
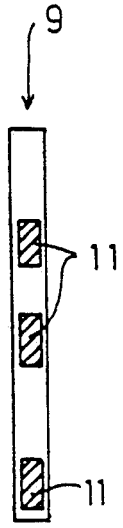
FIG. 4 on a larger scale a section through a hook element.

FIG. 4 shows in a larger scale section compared with FIG. 2 the hock, element 9. The pins 11 have a thickness which is smaller than that of the hook element 9 and are also positioned centrally with respect to the latter. Thus, on either side of the pins 11 an edge is formed, so that on inserting the hook material 9 into the front face 6 of the hanging folder, the material can engage on the front face along a relatively large surface, not only in the area between the pins 11, but also in the marginal area.

The hanging folder according to the invention is produced in that the hook elements 9 are injection moulded from plastic as mass-produced articles. The hanging folder blanks are then punched from corrugated board or a plastics material and during punching they can be given the recesses 4 and the bevelling of the upper corners. The blanks are folded and brought into the shape shown in FIG. 1. Subsequently four hook elements 9 are inserted into the front faces 6 in the vicinity of the recesses until they abut. Thus, the hanging folder is complete. As shown in FIG. 1 the back sheet 3 is higher, which leads to an upper surface which can be used for inscriptions. It can obviously also be provided with coloured stickers to facilitate orientation. It is also possible to injection mould from coloured plastic the said hook elements 9 in order to form organization aids. The upwardly projecting marginal area 12 of the back sheet 3 can easily be bent or folded rearwards in order to facilitate viewing.

If this is wished by a user, the hook elements 9 can be inserted at other points, e.g. somewhat higher or lower, as is apparent from FIG. 2.

However, even in the case of a finished hanging folder the final consumer can use it as a hanging file, by pulling out the hook elements 9 in the vicinity of the top surface, turning round the blank so that the bottom 2 is at the top and then inserting the hook elements 9 in the new top surface. It is obviously possible to provide on the front sheet 1 or the back sheet 3 on the top or bottom surface thereof a clipped or stitched strip for the filing of perforated material.

Figure 5:
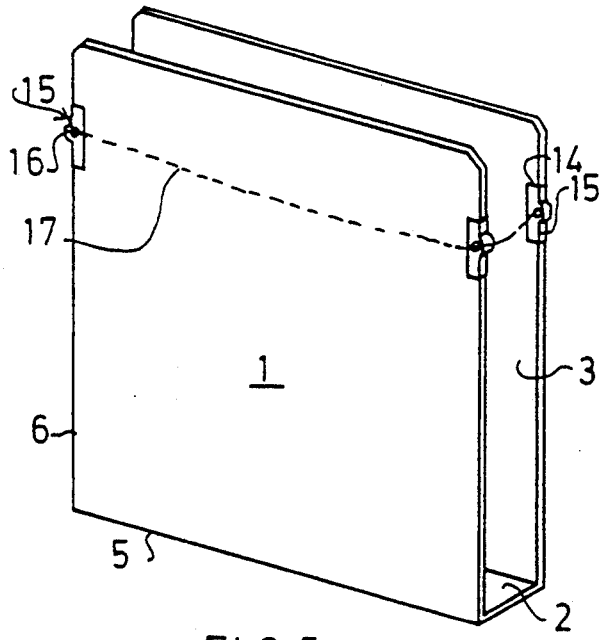
FIG. 5 a view of a rubber strip folder corresponding to FIG. 1.

FIG. 5 shows a view of a folder, which is conventionally referred to as a rubber strip folder which is similar to the representation of FIG. 1. In the represented embodiment the front sheet 1 and the back sheet 3 have the same height. Their production and folding take place in the same way as in the embodiment of FIG. 1, so that a further description is unnecessary here. In the upper area of the folder of FIG. 5 insert parts 15 are inserted in lateral recesses 14. The recesses 14 are shaped in such a way that the insert parts 15 are substantially flush with the material of the front sheet 1 and the back sheet 3. The insert parts 15 are inserted on the two front faces of both the front sheet 1 and the back sheet 3 and are all identical. Each insert part 15 contains a hole 16, whose axis extends at right angles to the plane of the sheets. FIG. 5 shows in broken line form a rubber strip 17, which is fixed to the insert parts 15 of the back sheet 3. It is passed over the insert parts 15 of the front sheet, i.e. not through the holes 16 therein. For opening the folder the rubber strip 17 is passed over the upper edge of the front sheet 1. Fastening to the insert parts 15 of the back sheet 3 can e.g. take place in such a way that the rubber strip is passed through the holes 16 and knotted on the other side.

It is also possible to pass the rubber strip round the complete folder. On one of the two sheets the insert parts 15 are used for fixing the rubber strip, whilst on the other sheet they are used for guiding said rubber strip or preventing damage to the folder material by forming a bearing surface for the rubber strip.

Figure 6:
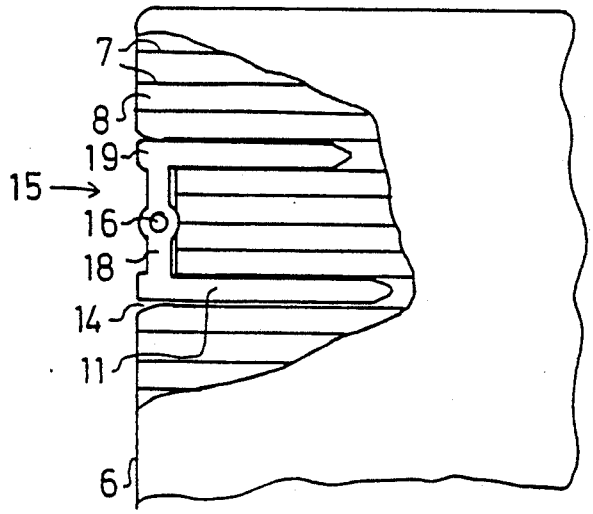
FIG. 6 a view corresponding to FIG. 2 of the embodiment of FIG. 5.

FIG. 6 shows on a larger scale the arrangement of the insert part 15 in the case of a rubber strip folder according to FIG. 5. Insertion takes place in the same way as described relative to FIG. 2. Thus, once again the insert part 15 has pins 11, in this case two pins, which have different lengths and engage in gaps 8 between the webs 7. The two pins are interconnected by a web 18 on the front side, i.e. the outside of the folder and said web is located in the recess 14. In a thickened portion roughly in the centre of the web a hole 16 is formed. In the vicinity of its two ends the web 18 has short, outwardly directed projections 19, located in the extension of the pins 11. This leads to the formation of a depression used for guiding the rubber strips 17 on the insert parts 15, where said rubber strip is not passed through the hole 16. The insertion of the insert parts and their dimensioning substantially corresponds to those of the embodiment of FIGS. 1 to 4, so that a repeated description is unnecessary.

Whilst the two embodiments provide different folder types, it is obviously possible in the case of a hanging folder according to FIGS. 1 to 4 to provide insert parts according to FIGS. 5 and 6 and it is obviously also possible to only guide the rubber strip within the folder so that papers can be fixed on one side in the hanging folder.

Claims:

1. Folder for hanging on rails, comprising:

a front cover and a back cover connected thereto, wherein the front cover and the back cover are punched from and formed from a blank, said blank including opposite lateral terminal edges, two spaced side sheets, and webs extending between said side sheets cover so as to form at least two gaps opening along each lateral terminal edge of at least one of the front cover and the back cover, and hook elements are provided for holding at least one of:

the front cover and the back cover on said rails, said hook elements each having at least two pins for lateral insertion into at least two of said gaps formed along a respective one of the opposite lateral terminal edges; and means for holding up another one of the front cover and the back cover with respect to the rails.

2. Folder according to claim 1, wherein the blank is corrugated board.

3. Folder according to claim 1, wherein the blank is plastic.

4. Folder according to claim 1, wherein it is constructed as a hanging folder.

5. Folder according to claim 1, wherein it is constructed as a hanging pocket.

6. Folder according to claim 1, wherein it is constructed as a hanging file.

7. Folder according to claim 1, wherein the back cover projects upwards over the front cover.

8. Folder according to claim 1, wherein the hook elements are integrally injection molded from plastic.

9. Folder according to claim 8, wherein the hook element is injected molded from colored plastic.

10. Folder according to claim 1, wherein each hook element has at least two pins of different lengths.

11. Folder according to claim 10, wherein there are at least three pins which have different spacings between each other.

12. Folder according to claim 10, wherein the thickness of the pins of each hook element is smaller than the remainder of the hook element.

* * * * *